United States Patent [19]

Igarashi et al.

[11] Patent Number: 4,539,578

[45] Date of Patent: Sep. 3, 1985

[54] HEAT SENSITIVE RECORDING MATERIAL

[75] Inventors: Akira Igarashi; Hiroharu Matsukawa, both of Shizuoka, Japan

[73] Assignee: Fuji Photo Film Co., Ltd., Kanagawa, Japan

[21] Appl. No.: 658,931

[22] Filed: Oct. 9, 1984

[30] Foreign Application Priority Data

Oct. 6, 1983 [JP] Japan ..... 58-187407

[51] Int. Cl.[3] ..... B41M 5/18

[52] U.S. Cl. ..... 346/207; 346/208; 346/209; 427/150; 427/151

[58] Field of Search ..... 346/207, 208, 209, 225; 427/150, 151, 152

[56] References Cited

FOREIGN PATENT DOCUMENTS

| | | | |
|---|---|---|---|
| 8194 | 1/1982 | Japan | 346/209 |
| 14094 | 1/1982 | Japan | 346/208 |
| 110289 | 6/1983 | Japan | 346/209 |

*Primary Examiner*—Bruce H. Hess

*Attorney, Agent, or Firm*—Sughrue, Mion, Zinn, Macpeak, and Seas

[57] ABSTRACT

A heat sensitive recording material is described, which has on a support a heat sensitive coloring layer containing (a) an electron-donating colorless dye, (b) an electron-accepting compound, and (c) at least one ether compound represented by formula (I) or (II)

(I)

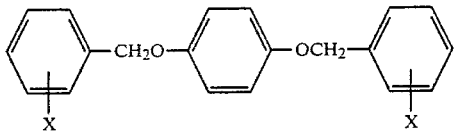

(II)

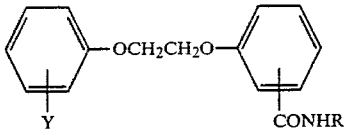

wherein X represents a hydrogen atom, a halogen atom, an alkyl group containing not more than 6 carbon atoms, or an alkoxy group containing not more than 6 carbon atoms; Y represents a hydrogen atom, a halogen atom, an alkyl group containing not more than 6 carbon atoms, or an alkoxy group containing not more than 6 carbon atoms; and R represents a hydrogen atom or an alkyl group containing not more than 18 carbon atoms.

6 Claims, No Drawings

HEAT SENSITIVE RECORDING MATERIAL

FIELD OF THE INVENTION

The present invention relates to a heat sensitive recording material, and more particularly to a heat sensitive recording material which has on a support a heat sensitive recording layer containing an electron-donating colorless dye and an electron-accepting compound.

BACKGROUND OF THE INVENTION

Heat sensitive recording materials which utilize combinations of electron-donating colorless dyes and electron-accepting compounds are disclosed, e.g., in Japanese Patent Publications 14039/70, 4160/68, and so on.

Characteristics that the heat sensitive materials of the above-described kind should possess include, to say the least, (1) to produce developed image having sufficiently high color density and sufficiently high coloring speed, (2) to generate no fog (e.g., coloring phenomenon upon storage before use), (3) to provide a coloring product having sufficiently high color fastness, and so on. However, materials which perfectly possess these desired properties have not yet been obtained.

In keeping step with the recent speeding-up of heat sensitive recording systems, concentrated study of the above-described characteristics (1) has particularly been made. Specifically, a method of using an oxybenzoic acid ester as an electron accepting compound (Japanese Patent Application (OPI) No. 144193/81 (The term "OPI" as used herein refers to a "published unexamined Japanese patent application.)), a method of using a salicyclic acid ester as an electron accepting compound (Japanese Patent Application (OPI) No. 201693/82), and so on are disclosed. However, the combinations of electron-donating colorless dyes (also referred to hereinafter as a color former) and electron-accepting compound (also referred to hereinafter as a color developer) which can effect the acquirement of the property (1) are generally inferior with respect to ensuring the properties (2) and (3) and therefore, require some measure to prevent generation of fog and discoloration.

On the other hand it has already been known that heat sensitive materials which provide coloring products having excellent color fastness and generate appreciably reduced fog can be obtained by combining the color former of triarylmethane type, diphenylmethane type, xanthene type, thiazine type or spiropyran type with the color developer of phenol type, especially bisphenol type. However, those combinations were found to have insufficient coloring speed.

SUMMAR OF THE INVENTION

Therefore, a primary object of the present invention is to provide a heat sensitive recording material which has a high coloring speed; reduced fog density, and excellent color fastness. The term "coloring speed" used herein means a color density based on thermal energy applied to the heat sensitive recording materials, i.e., it is referred to as "a low printing power". That is, the higher the color density at lower thermal energy, the higher the coloring speed.

The above-described object of the present invention is attained with a heat sensitive recording material which has on a support a heat sensitive coloring layer containing (a) an electron-donating colorless dye, (b) an electron accepting compound and further, (c) at least one ether compound represented by formula (I) or (II)

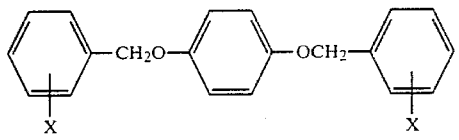

(I)

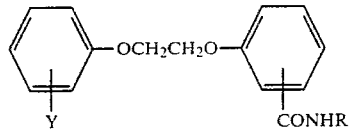

(II)

wherein X represents a hydrogen atom, a halogen atom, an alkyl group containing not more than 6 carbon atoms, or an alkoxy group containing not more than 6 carbon atoms; Y represents a hydrogen atom, a halogen atom, an alkyl group containing not more than 6 carbon atoms, or an alkoxy group containing not more than 6 carbon atoms: and R represents a hydrogen atom or an alkyl group containing not more than 18 carbon atoms.

DETAILED DESCRIPTION OF THE INVENTION

Specific examples of ether compounds to be employed in the present invention are illustrated below.

Compound (1)

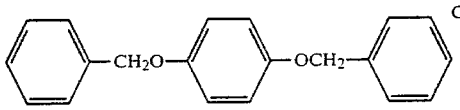

Compound (2)

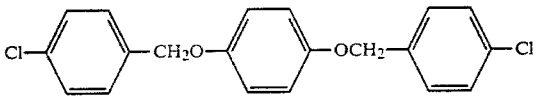

Compound (3)

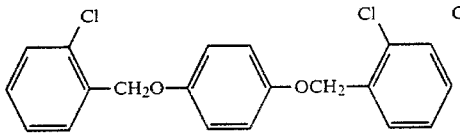

Compound (4)

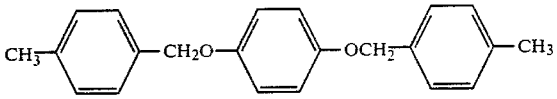

Compound (5)

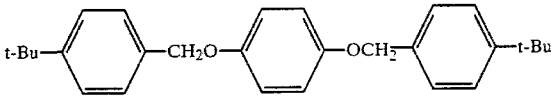

Compound (6)

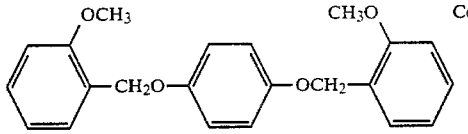

-continued

Compound (7)

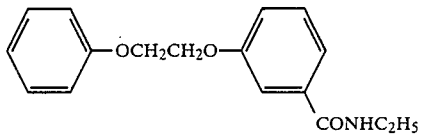

Compound (8)

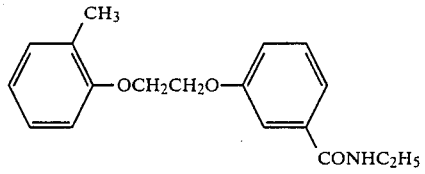

Compound (9)

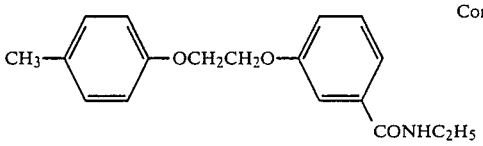

Compound (10)

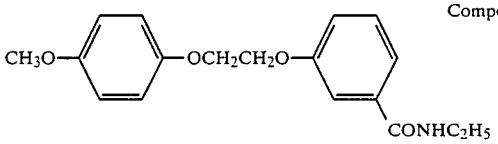

Compound (11)

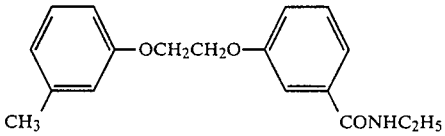

Compound (12)

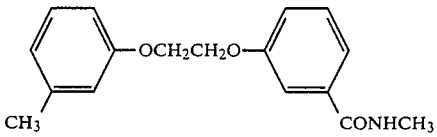

Compound (13)

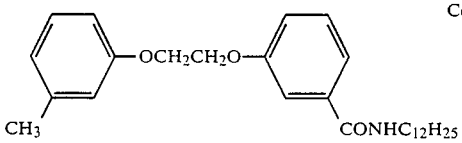

The heat sensitive recording material of the present invention can be produced, e.g., as follows. A color former and a color developer are dispersed in separate solutions of a water-soluble high polymer (binder) using a means such as a ball mill. The ether compound of the present invention is also dispersed separately in a similar manner as above, or it is previously mixed with either color former or color developer and then, dispersed in a binder simultaneously with the color former or color developer. The dispersing step is continued until the volume average particle size becomes 5 μm or less, and more preferably 2 μm or less. The volume average particle size is determined by the following relationships:

$$\frac{4}{3}\pi\left(\frac{\phi}{2}\right)^3 = \left(\frac{\text{The total volume of particles}}{\text{The total number of particles}}\right)$$

-continued $$\phi = \left(\frac{6}{\pi} \times \frac{\text{The total volume of particles}}{\text{The total number of particles}}\right)^{\frac{1}{3}}$$

Therefore, the unit thereof is "μm (linear parameter)".

After conclusion of the individual dispersion steps, the resulting dispersions are mixed to prepare a heat sensitive coating composition.

To the heat sensitive coating composition there can be added additionally an inorganic or organic oil-absorbing agent, a metal soap or the like for the purpose of preventing stains from adhering to a thermal head upon printing, waxes or the like for the purpose of improvement in smoothness of the heat sensitive recording layer surface, and a cross-linking agent for the water soluble high polymer, a latex binder or the like for the purpose of imparting a water resisting property to the heat sensitive recording layer.

In some cases, a dispersion of a thermofusible substance is further added to the heat sensitive coating composition for the purpose of controlling the coloring initiation temperature.

The thus prepared coating composition is coated on a support such as a sheet of paper or synthetic paper, plastic film or the like, and then dried. Thus, an intended heat sensitive recording material is obtained.

Suitable examples of color former which can be employed in the present invention include triarylmethane compounds, diphenylmethane compounds, xanthene compounds, thiazine compounds, spiropyran compounds and so on. More specifically, they include, e.g., 3,3-bis(p-dimethylaminophenyl)-6-dimethylaminophthalide (i.e., Crystal Violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide, 3-diethyl-amino-7-methoxyfluoran, 3-diethylamino-6-methoxyfluoran, 3-diethylamino-7-dibenzylaminofluoran, 3-diethylamino-6-methyl-7-anilinofluoran, 3-N-ethyl-N-tolylamino-6-methyl-7-anilinofluoran, 3-N-methyl-N-tolylamino-6-methyl-7-anilinofluoran, 3-piperidino-6-methyl-7-anilinofluoran, 3-diethylamino-6-chloro-7-anilinofluoran, 3-N-cyclohexyl-N-methylamino-6-methyl-7-anilinofluoran, 3-piperidino-6-methyl-7-(p-methylanilino)fluoran, 3-diethylamino-7-(o-chloroanilino)fluoran, 3-diethylamino-7-butylaminofluoran, 3-diethylamino-7-diphenetylaminofluoran, 3,7-bis(methyltolylamino)-fluoran, 3-piperidino-7-phenetylaminofluoran, 3-diethylamino-7-phenylfluoran, 3-diethylamino-7,8-benzofluoran, and so on.

These dyes may be used individually, or in the form of mixtures thereof for purposes of tone adjustment.

Suitable examples of color developer which can be used in the present invention include bisphenols, such as 2,2-bis(4'-hydroxyphenyl)propane (bisphenol A), 2,2-bis(4-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'- hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4-hydroxyphenyl)-2-ethylhexane, 1,1-bis(4'-hydroxyphenyl)dodecane and the like; salicylic acids such as 3,5-di-α-methylbenzylsalicylic acid, 3,5-di-tert-butylsalicylic acid, 3-α,α-dimethylbenzylsalicylic acid, etc., and polyvalent metal salts thereof (especially zinc salts and aluminum salts thereof; oxybenzoic acid esters such as benzyl p-hydroxybenzoate; 2-ethylhexyl p-hydroxybenzoate, etc.; and phenols such as p-phenylphenol, 3,5-diphenylphenol, cumylphenol, etc. Of these compounds, bisphenols are particularly preferred.

Suitable binders which can be used in the present invention are those which can be dissolved in 25° C. water in a proportion of not less than 5 wt.%. More specifically, they include methyl cellulose, carboxymethyl cellulose, hydroxyethyl cellulose, starch, gelatin, gum arabic, casein, hydrolysis products of styrene-maleic anhydride copolymers, hydrolysis products of ethylene-maleic anhydride copolymers, hydrolysis products of isobutylene-maleic anhydride copolymers, polyvinyl alcohol, carboxy denatured polyvinyl alcohol (polyvinyl alcohol/acrylic acid copolymer) and so on.

Suitable oil absorbing pigments which can be used include inorganic pigments such as zinc oxide, calcium carbonate, barium sulfate, titanium oxide, lithopone, talc, agalmatolite, kaolin, aluminum hydroxide, calcined kaolin, amorphous silica, etc., and organic pigments such as ureaformaldehyde resin, polyethylene powder, etc.

Suitable examples of metal soaps which can be used include metal salts of higher fatty acids, such as zinc stearate, calcium stearate, aluminium stearate and the lile.

Suitable waxes which can be used include polyethylene wax, carnauba wax, paraffin wax, microcrystalline wax, fatty acid amide and so on.

Suitable examples of water resistance imparting agents which can be used are dependent on water-soluble high polymer used together therewith. However, formaldehyde, methylol melamine, boric acid and so on are generally used.

Water-insoluble binders which can be used are generally synthetic rubber latexes or synthetic resin emulsions. Specific examples thereof include styrene-butadiene rubber latex, acrylonitrile-butandiene rubber latex, methylacrylate-butadiene rubber latex, vinyl acetate emulsion and so on.

The ether compound of the present invention is used in an amount, preferably, of from 10 wt% to 200 wt%, and more preferably from 50 wt% to 120 wt%, based on the weight of the color developer (electron-accepting compound) used. If the ether compound is used in a proportion of lower than 10 wt%, it tends to produce insufficient effect on increase in coloring speed, whereas if more than 200 wt% is used, it is economically unattractive.

The present invention is illustrated in greater detail by reference to the following examples. However, the present invention should not be construed as being limited to the examples.

EXAMPLES 1 TO 6

10 parts by weight of 2-anilino-3-methyl-6-diethylaminofluoran was employed as a color forming agent, and dispersed together with 50 parts by weight of a 5% solution of polyvinyl alcohol (saponification degree: 98%, polymerization degree: 500) using a ball mill. Thus, a color former dispersion having a mean dispersed particle size of 2.8 μm was obtained.

10 parts by weight of 2,2-bis(4-hydroxyphenyl)propane and 10 parts by weight of one of the compounds set forth in Table 1 were employed as the color developer and the ether compound of the present invention, respectively. These were dispersed together with 100 parts by weight of a 5% solution of polyvinyl alcohol using a ball mill. Thus, a color developer dispersion having a mean particle size of 3.2 μm was obtained.

The color former dispersion and the color developer dispersion were mixed, and 25 parts by weight of lightweight calcium carbonate was added thereto and stirred thoroughly. To the resulting dispersion, 10 parts by weight of a 20% dispersion of zinc stearate and 10 parts by weight of a 20% dispersion of paraffin wax were further added to prepare a heat sensitive coating composition.

The thus-prepared heat sensitive coating composition was coated using a Mayer bar on wood free paper having a basis weight of 50 g/m$^2$ in an amount such that the coverage thereof was 5 g/m$^2$ on a solids basis, and dried at 50° C. for 2 minutes to produce a heat sensitive recording paper. The heat sensitive recording paper was subjected to a super-calendering processing under a pressure of 10 kg/cm, and characters were printed thereon using a facsimile machine made by Toshiba Co., Ltd. (trademark: COPIX-6200) under conditions such that the printing powder was set at a level lower than the prescribed level by 30%, and the density of record obtained was meassured using a Macbeth RD-918 densitometer. Printed samples were allowed to stand in an atmosphere regulated at 50° C. and 90% relative humidity (RH) for 24 hours, and thereafter, the rate of decrease in density of the printed part, and the density of fog in non-printed patt, were measured. Accordingly, the higher the initial density of printed characters is, and the lower both the rate of decrease in density of printed characters and the fog value are, the better the heat sensitive recording paper answers the purpose of the present invention. In the same condition, the higher the color density, the higher the coloring speed.

COMPARATIVE EXAMPLE 1

A heat sensitive recording paper was produced in the same manner as in the above-described examples except that the ether compound of the present invention was not admixed at the time of dispersing the color developer, but rather 2,2-bis(4-hydroxyphenyl)propane was used in an amount of 20 parts by weight.

COMPARATIVE EXAMPLE 2

A heat sensitive recording paper was produced in the same manner as in Examples 1 to 6, except that benzyl 4-hydroxybenzoate was used as the color developer in an amount of 20 parts by weight, and any ether compound according to the present invention was not mixed therewith.

EXAMPLES 7 AND 8

Heat sensitive recording papers were produced in the same manner as in Example 1 and Example 4, respectively, except that the color developer was replaced by 1,1-bis(4-hydroxyphenyl)cyclohexane.

Results of the examples and the comparative examples are illustrated in Table 1. As can be clearly seen from the data in Table 1, the ether compounds of the present invention are excellent in providing a color speed increasing effect.

TABLE 1

| | Ether Compound | Density of Printed Characters | Lowering Rate of Density | Fog |
|---|---|---|---|---|
| Example 1 | 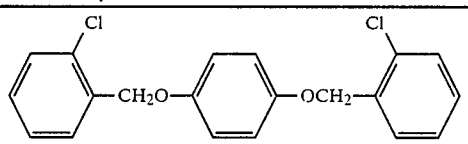 | 1.01 | 8% | 0.07 |
| Example 2 | 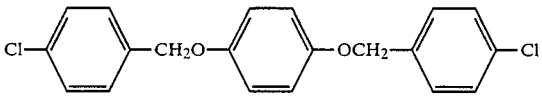 | 0.92 | 11% | 0.07 |
| Example 3 | 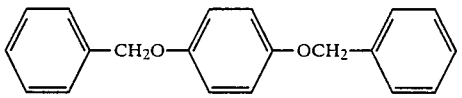 | 0.95 | 6% | 0.07 |
| Example 4 | 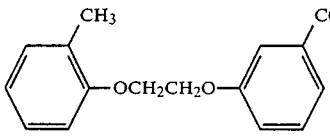 | 0.96 | 5% | 0.08 |
| Example 5 | 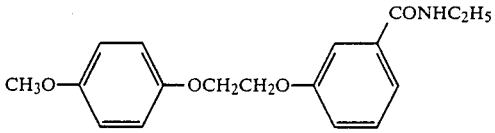 | 0.88 | 5% | 0.07 |
| Example 6 | 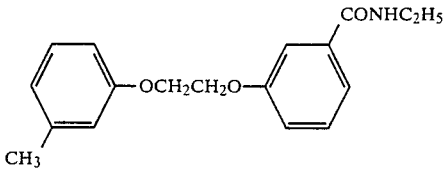 | 0.91 | 3% | 0.06 |
| Comparative Example 1 | — | 0.51 | 15% | 0.07 |
| Comparative Example 2 | — | 0.80 | 73% | 0.10 |
| Example 7 | 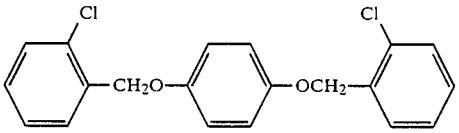 | 0.88 | 11% | 0.06 |
| Example 8 | 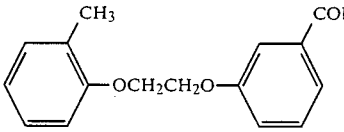 | 0.91 | 16% | 0.05 |

While the invention has been described in detail and with reference to specific embodiments thereof, it will be apparent to one skilled in the art that various changes and modifications can be made therein without departing from the spirit and scope thereof.

What is claimed is:

1. A heat sensitive recording material having on a support a heat sensitive coloring layer which contains (a) an electron-donating colorless dye, (b) an electron-accepting compound and (c) at least one ether compound represented by formula (I) or (II)

(I)

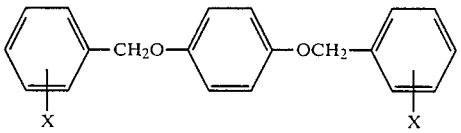

-continued (II)

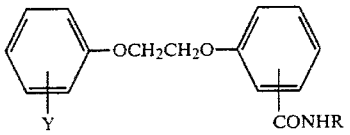

wherein X represents a hydrogen atom, a halogen atom, an alkyl group containing not more than 6 carbon atoms, or an alkoxy group containing not more than 6 carbon atoms; Y represents a hydrogen atom, a halogen atom, an alkyl group containing not more than 6 carbon atoms, or an alkoxy group containing not more than 6 carbon atoms; and R represents a hydrogen atom or an alkyl group containing not more than 18 carbon atoms, said ether compound is used in an amount of from 10 wt% to 200 wt% based on the weight of the electron-accepting compound.

2. A heat sensitive recording material as in claim 1, wherein the ether compound represented by formula (I) or (II) is dispersed in a volume average particle size of 5 μm or less.

3. A heat sensitive recording material as in claim 2, wherein the ether compound represented by formula (I) or (II) is used in an amount from 50 wt% to 120 wt% based on the weight of the electron-accepting compound.

4. A heat sensitive recording material as in claim 1, wherein the ether compound represented by formula (I) or (II) is used in an amount from 50 wt% to 120 wt% based on the weight of the electron-accepting compound.

5. A heat sensitive recording material as in claim 1, wherein the ether compound represented by formula (I) or (II) is dispersed in a volume average particle size of 2 μm or less.

6. A heat sensitive recording material as in claim 5, wherein the ether compound represented by formula (I) or (II) is used in an amount from 50 wt% to 120 wt% based on the weight of the electron-accepting compound.

* * * * *